US011332949B2

(12) United States Patent
Simpson et al.

(10) Patent No.: US 11,332,949 B2
(45) Date of Patent: May 17, 2022

(54) POOL DRAIN SUCTION OUTLET FITTING

(71) Applicant: Custom Molded Products, LLC, Newnan, GA (US)

(72) Inventors: Richard Simpson, Tyrone, GA (US); Angelo V. Pugliese, Newnan, GA (US); Zachary T. Vogtner, Fayetteville, GA (US)

(73) Assignee: Custom Molded Products, LLC, Newnan, GA (US)

( * ) Notice: Subject to any disclaimer, the term of this patent is extended or adjusted under 35 U.S.C. 154(b) by 36 days.

(21) Appl. No.: 16/913,574

(22) Filed: Jun. 26, 2020

(65) Prior Publication Data

US 2020/0407993 A1 Dec. 31, 2020

Related U.S. Application Data

(60) Provisional application No. 62/868,142, filed on Jun. 28, 2019.

(51) Int. Cl.
*E04H 4/12* (2006.01)

(52) U.S. Cl.
CPC ..... *E04H 4/1236* (2013.01)

(58) Field of Classification Search
CPC ..... E04H 4/1236; E04H 4/12
USPC ..... 4/507
See application file for complete search history.

(56) References Cited

U.S. PATENT DOCUMENTS

| | | | | |
|---|---|---|---|---|
| 9,540,837 | B2 * | 1/2017 | Mjelde | E04H 4/1236 |
| 10,214,930 | B1 * | 2/2019 | Mjelde | E04H 4/1236 |
| 2007/0180604 | A1 * | 8/2007 | Griffin | E04H 4/1236 4/507 |
| 2012/0096635 | A1 * | 4/2012 | Afshar | E04H 4/1236 4/507 |
| 2019/0218807 | A1 * | 7/2019 | Goettl | E04H 4/1236 |

* cited by examiner

*Primary Examiner* — Huyen D Le
(74) *Attorney, Agent, or Firm* — Laurence P. Colton; Smith Tempel Blaha LLC

(57) ABSTRACT

A pool drain or sump basin having elongated ring-shaped body, at least one and preferably a plurality of outlet ports about the ring-shaped body for allowing water to exit the drain, external peripheral flanges for mounting the drain, and an opening for allowing water to enter the drain, the ring-shaped body having an inner sidewall and outer sidewall, and open topside, and a closed bottom or floor closing off the bottom side of the body, bridging the gap between the inner sidewall and the outer sidewall, and creating a drainage channel. The body may have an optional cover configured as a removable or replacement cover with openings. The pool drain may have optional bridging elements and flow regulating elements for greater structural support and water flow regulation through the pool drain.

39 Claims, 10 Drawing Sheets

POOL DRAIN SUCTION OUTLET FITTING

CROSS REFERENCE TO RELATED APPLICATIONS

This patent application claims priority on and the benefit of U.S. Provisional Patent Application No. 62/868,142 having a filing date of 28 Jun. 2019.

BACKGROUND OF THE INVENTION

Technical Field

The present disclosure generally relates to pool suction outlet fittings, which also are commonly known in the art as pool drains or sumps, including sump basin fittings capable of allowing water to flow from the basin to a pump and filter for recirculation. More specifically, the present disclosure is directed to a recessed or inset system for draining or recirculating water in a water vessel or basin such as a spa, swimming pool, hot tub, garden bath, and the like. The present invention also is directed to the formation or insertion of a drainage/recirculation device into, or through, the side wall(s) or floor defining the water-containing portion of a spa, swimming pool, hot tub, garden bath, or the like.

Prior Art

Artificial bodies of water such as spas, swimming pools, hot tubs, garden baths, and the like derive benefits from the addition of both aesthetically pleasing features and safety features. Modern drain regulations for these artificial bodies of water, as well as modern developments in the art, make pool drains a perfect feature for pool and spa manufacturers to focus on in developing aesthetically pleasing drains that are safe for users.

For example, the common regulatory requirements for two pool drains structured so that a user likely would not become caught and stuck in the pool drain usually results in pool drains being configured as unsightly rectangular channels or high surface area grate drains. In particular, some of these grate drains usually take the form of rounded or circular drains with drain covers having recessed surfaces or openings. The recessed surface or opening being for the application of a "masking" or "hiding" agent being either of a material similar to the surrounding inner surface of the artificial body of water upon which the pool drain is defined, inset, or recessed, or being of the exact same material used during or after fabrication or laying of the artificial body of water. Some of these pool drains are comprised of multiple components glued or welded together creating a potential leak path.

Channel drains, which typically are linear in structure, require alignment to a wall or other pool feature during installation so as to be aesthetically pleasing. If even slightly misaligned, the misalignment can be noticeable. A circular drain structure has less need for alignment and therefore can be quicker and simpler to install.

As the market for spas, swimming pools, hot tubs, garden baths, and the like grows, users desire more, different, better, more interesting, and more aesthetically pleasing drainage systems and methods of draining to make, for example, their bathing experience more relaxing, more convenient, and safer. Further, professionals that build pools, spas, and the like, desire drainage systems that are more reliable, easier to install, and easier to maintain.

Accordingly, there is a need for new and different drainage devices and methods for draining artificial bodies of water and the like. There also is a need for a reliable, efficient, and effective pool drain fitting ("pool drain" or "sump basin" for simplicity, as used in the Detailed Description) that is minimalist in dimensions and materials, without sacrificing function, that is aesthetically pleasing and well hidden, and that has a design and shape to maximize the drainage function, yet still maintains an acceptable level of safety. It is to these needs and others that the present invention is directed.

BRIEF SUMMARY OF THE INVENTION

Briefly, the present invention is for a pool drain or sump basin. In one exemplary embodiment, an injection-molded hollow drain has an elongated ring-shaped body, at least one, and preferably a plurality of, outlet ports about the ring-shaped body for allowing water to exit the drain, external peripheral flanges for mounting the drain, and an opening for allowing water to enter the drain.

In another exemplary embodiment, the ring-shaped body has an inner sidewall and outer sidewall with the topside of the body open. The bottom or floor of the body closes off the opposite side of the body, bridging the gap between the inner sidewall and the outer sidewall, and creating a drainage channel. The body may have an optional cover configured as a removable or replacement cover with openings, such as slits or holes or any other shape. Although the openings may be designed to reduce the passage of debris into the drainage channel, this is not necessarily a requirement in all applications of the invention.

In another exemplary embodiment, the outlet ports are situated about the ring-shaped body, and are in fluid communication with a corresponding number of cylindrical conduits for draining water from the drainage channel of the body. The drainage channel is defined by the inner sidewall, the outer sidewall, and the floor of the body.

In another exemplary embodiment, the area circumscribed by the inner wall of the ring-shaped body, external to the drainage channel, is a completely open center area that is devoid of any system components or structures, and is configured to receive a filler material to attractively blend the drain system with the pool wall(s) or floor.

In another exemplary embodiment, at least one bridging element is included to provide additional support for a grate cover for covering the drainage channel and provide support to the inner and outer sidewalls preventing the walls from deformation due to stresses incurred as the surrounding surface material (gunite, cement, concrete, shotcrete, plaster, Pebble Tech®, etc.) cures. The surface material will exert force on the walls of the drain as the material cures whereby the inner and outer sidewalls would be pushed toward each other making the top opening narrower. This condition can prevent any optional drain cover from being installed into the opening. The bridging element also interrupts or substantially interrupts, depending on the size and structure of the bridging element, the top opening of the drainage channel to as to affect the flow of water into the drainage channel.

In another exemplary embodiment, the bridging element has a flow regulating feature depending downward into the drainage channel. The flow regulating feature interrupts or substantially interrupts, depending on the design of the flow regulating feature, the flow of water within the drainage channel. The flow interruption can reduce turbulence in the flow of water within the drainage channel, which can help prevent hair entrapment, and also can trap debris that enters the drainage channel through the grate cover thus preventing such debris from traveling into the water pumping system.

These features, and other features and advantages of the present invention will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

In the figures, for reference numerals with letter character designations such as "102*a*" or "102*b*", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Figure 1:
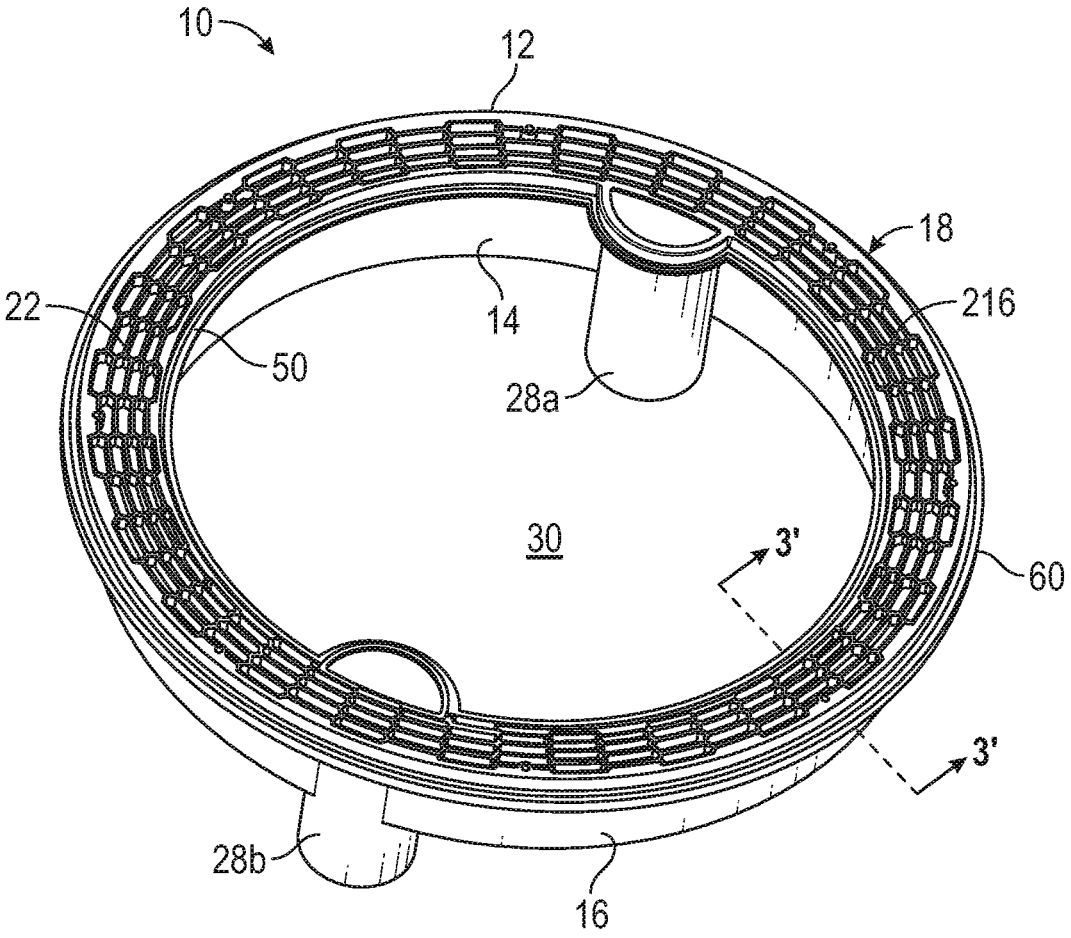
FIG. 1 is a front perspective view of a first exemplary embodiment of a pool drain of the present invention.

For a further understanding of the nature, function, and objects of the present invention, reference should now be made to the following detailed description. While detailed descriptions of the preferred embodiments are provided herein, as well as the best mode of carrying out and employing the present invention, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Embodiments and aspects of the present invention provide a device and a system for draining an artificial body of water or pool that is not susceptible to the limitations and deficiencies of the prior art. The inventive concepts described herein, in certain non-limiting embodiments, allow for the formation or insertion of a drainage device into a pool such that the drainage device functions as a sump basin and pool drain, and such that the drainage device is efficiently and effectively camouflaged or hidden from a user's view, and from contact with a user or pool equipment (e.g., a pool vacuum, an automatic pool cleaner).

The inventive concepts described herein also allow for inserting, embedding, recessing, and insetting, in certain non-limiting embodiments, a pool drain into, or through, the side wall(s) or floor defining the water-containing portion of an artificial body of water. The inventive concepts described herein also allow for a recessed or inset pool drain that is less susceptible to boundary cracking or fracturing and is less susceptible to manufacturing-, machining-, or joint-cracking or fracturing.

The inventive concepts described herein also allow for a pool drain that is efficient and effective, that is minimalist in dimensions and materials, without sacrificing function, that is aesthetically pleasing and well-hidden, and that facilitates different aesthetic designs and shapes to maximize the drainage function. For example, the inventive concepts described herein facilitate other parallel- or related-functions, such as facilitating installation or use of a hydrostatic relief valve (to relieve hydrostatic pressure acting on the interface of the artificial body of water and underlying substrate, for example), preventing or reducing the chance and/or extent of hair entrapment, and for regulating or affecting the flow of water within the pool drain. This allows for efficiencies in time, labor, and resources, in manufacturing and maintaining artificial bodies of water, and for a streamlining and simplifying of the types of systems/devices capable of solving the problems inherent in the prior art. This also allows for a drainage solution that more readily complies with modern regulatory standards.

As context, a sump or drainage basin generally is known as a low space in a defined body wherein the basin collects material from the broader body, usually via gravity, but in the case of pools also via suction. An artificial body of water or pool generally comprises a gunite (concrete), plaster, plastic, or fiberglass body, made up of sidewalls, edges, openings, conduits, filler, etc., defining a water-containing portion or vessel. A prior art pool drain generally comprises a plastic body component for the broader pool, usually installed along the floor or bottom of the pool, defining a sump or drainage basin into which waterflow from the pool is removed and recirculated via the pool's pump and filter.

At the most basic level, a pool drain comprises an opening, inlet, or intake that connects to an outlet, conduit, or pipe that is in fluid communication with a pool pump and filter. When installed onto a pool, such pool drains define an outlet port for the broader and complete artificial body of water. In one example, a pool drain is configured as an elongated or spread-out inlet/intake such that a single pool-user likely would not cover the entire inlet/intake or risk becoming trapped by the associated force of draining or suctioned water. Such pool drains are classified as "unblockable" drains in the industry as well by as the US Consumer Product Safety Commission (USCPSC) and governing bodies that regulate, certify and enforce pool/spa drain safety These pool drains often are configured as unsightly rectangular channels or high surface area grate drains with such features as multiple intake ports (distinct from multiple outlet ports), and being of a sufficient length that the additional multiple ports cannot be simultaneously blocked.

A problem with such pool drains, particularly elongated or high surface area drains, is that some of these drains have recessed surfaces, cavities, openings, nooks, or crannies for the application of a "masking", "hiding", filler, or bonding material. Over time, the material into which the pool drain is embedded forms cracks and fissures due to expansion and contraction, and natural erosive-forces like temperature, water, and chemical attack. In another example, the boundary where the pool drain and material meet is a junction prone to forming cracks, and a junction prone to fracturing away from the surrounding material. This is particularly problematic as water may seep into the surrounding material and then down into the supporting walls or floor of the pool, and/or surrounding substrate, which ultimately may cause further damage.

Another problem with such pool drains, particularly elongated or high-surface area drains, is that some of these drains rely on complicated plumbing pathways and conduit structures, that while seemingly solving the drainage hazard present in the prior art, lend themselves to more complicated manufacturing or machining designs and processes. In one example, an elongated and spread-out conduit portion of a pool drain, intended to solve the problems in the prior art, in actuality cannot be injection molded hollow, in one piece, with the rest of the pool drain body, thereby requiring the pool drain to be molded in separate casts and then joined together. This is particularly problematic as the manufacturing- or machining-joint(s) in these pool drains create a potential (and likely) leak path, which ultimately may cause further damage.

With the above context in mind, a first exemplary embodiment of the present invention provides an efficient, effective, safe, and versatile pool drain system for connecting to the pump and filter of a pool, wherein the drain system defines a ring-like inlet or intake opening and comprises at least one, and preferably two or more outlet ports, and wherein the drain system is efficiently and effectively camouflaged or hidden from a user's view, or from contact with a user or pool equipment, but whereby the drain system is configured for inserting, embedding, recessing, and insetting into, or through, the side wall(s) of floor defining the water-containing portion of the pool. The drain system is less susceptible to boundary cracking or fracturing, and less susceptible to manufacturing-, machining-, or joint-cracking or fracturing. The surrounding material meets the pool drain along a substantive component of the drain system, which is ideally injection-molded hollow or of unibody construction, and which has minimal manufacturing- or machining-joints.

A second exemplary embodiment of the present invention provides a pool drain comprising a ring-like body configured as a drainage channel, and having a corresponding ring-like inlet or intake opening accessible to the pool, wherein the drainage channel is in fluid communication with the pool, and is accessible from the pool via the ring-like inlet/intake opening on one side. The pool drain additionally comprises, on another side, two or more independent outlet ports for fluid communication with the pool's pump and filter and for channeling fluid from the drainage circuit. Each outlet port is separated from the other(s) by the maximum distance possible based on the ring-like inlet/intake opening. Further, the ring-like body defines an internal space or area, external to the drainage circuit, but internal to the body forming the drainage circuit, wherein a "masking", "hiding", filler, or bonding material can be placed so as to fill the internal space, whereby the pool drain attractively blends in with the pool wall(s) or floor.

A third exemplary embodiment of the present invention provides a pool drain system comprising an annular or ring-shaped body for embedding into, or through, the main body/side wall(s) or floor of a pool. The area or space circumscribed by the inner wall of the ring-shaped body, external to the drainage channel, defined by the walls of the ring-shaped body, is devoid of any system components or structures, and is configured to receive a filler material to attractively blend the drain system with the pool wall(s) or floor. The pool drain system additionally comprises two or more independent outlet ports, each equally separated from the other(s) about the ring-shaped body, the ring-shaped body being large enough such that a single pool-user would not cover the entire inlet/intake opening of the ring-shaped body, or risk becoming trapped by the associated force or suction. The use of two or additional ports will still allow the pulling of water to the pump in the event that one of the ports gets clogged with debris, or if a port should get blocked by a bather's hair. In this manner, the invention provides for a safety aspect (reducing or preventing the suction of hair) and a performance aspect (not starving the pump if one port is clogged). The pool drain additionally comprises an annular or ring-shaped grate cover, or cover with openings, corresponding to the opening of the ring-shaped drainage channel.

When a drain becomes obstructed (by a human body for example), the locations of the ports will not necessarily prevent the obstruction or entrapment. As long as the drain cover/opening is not completely blocked, water will be able to flow through any unobstructed portion into the channel and then into the outlet port, regardless of where the port(s) is/are on the channel. The suction force may be highest where the ports are located, but as long as there is some portion of the cover/opening unobstructed water will flow to the outlet(s). Thus, it is the size of the drain (diameter of the opening/cover) that makes the drain "unblockable" and prevents a single user from obstructing the entire drain. Under current safety regulations, if the drain cover/opening cannot be completely shadowed by an 18-inch by 23-inch element (with 4-inch radius corners), the drain is considered unblockable. The 18-inch by 23-inch size represents the torso of a 99th percentile male. Thus, the port quantity and location are independent of the "unblockability" of the drain. If the drain is made in a size that is too small to be considered unblockable, then it would be necessary to install multiple drains (e.g., at least two drains per pump) with each drain spaced at least three feet apart to avoid entrapment risk according to current drain regulations. Thus, the invention does not need to be unblockable per se by being of a certain size or larger, but being of an unblockable size has certain advantages as discussed above.

A fourth exemplary embodiment of the present invention provides a pool drain system comprising an annular or ring-shaped body for embedding into, or through, the floor of a pool. The area or space circumscribed by the inner wall of the ring-shaped body, external to the drainage channel, defined by the walls of the ring-shaped body, is devoid of any system components or structures, and is configured to receive a filler material to attractively blend the drain system with the pool floor. The pool drain system additionally comprises two or more independent outlet ports, each equally separated from the other(s) about the ring-shaped body. The pool drain additionally comprises an annular or ring-shaped grate cover, or cover with openings, corresponding to the opening of the ring-shaped drainage channel, and at least one bridging element to provide support for the sidewalls of the drainage channel and to provide additional support for the grate cover for covering the drainage channel. The bridging element also interrupts or substantially interrupts, depending on the size and structure of the bridging element, the top opening of the drainage channel to as to affect the flow of water into the drainage channel.

A fifth exemplary embodiment of the present invention provides a pool drain system comprising an annular or ring-shaped body for embedding into, or through, the floor of a pool. The area or space circumscribed by the inner wall of the ring-shaped body, external to the drainage channel, defined by the walls of the ring-shaped body, is devoid of any system components or structures, and is configured to receive a filler material to attractively blend the drain system with the pool floor. The pool drain system additionally comprises two or more independent outlet ports, each equally separated from the other(s) about the ring-shaped body. The pool drain additionally comprises an annular or ring-shaped grate cover, or cover with openings, corresponding to the opening of the ring-shaped drainage channel, and at least one bridging element to provide support for the sidewalls of the drainage channel and to provide additional support for the grate cover for covering the drainage channel. The bridging element has a flow regulating feature depending downward into the drainage channel that interrupts or substantially interrupts, depending on the design of the flow regulating feature, the flow of water within the drainage channel. The flow interruption can reduce turbulence in the flow of water within the drainage channel, reduce the risk of entrapment, and also can trap debris that enters the drainage channel through the grate cover thus preventing such debris from traveling into the water pumping system.

The drainage channel of the exemplary embodiment is defined by the inner wall, outer wall, and floor of the main body. When the pool drain system is installed into the pool wall(s) or floor, the opening of the drainage channel, with or without the cover, preferably is substantially flush with the pool wall(s) or floor. The pool drain system additionally comprises external flanges extending outward from (relative to the outer wall of the ring-shaped body) and inwards from (relative to the inner wall of the ring-shaped body) the opening of the drainage channel, to help prevent water from passing through the boundary between the main body and the surrounding material.

Figure 2:
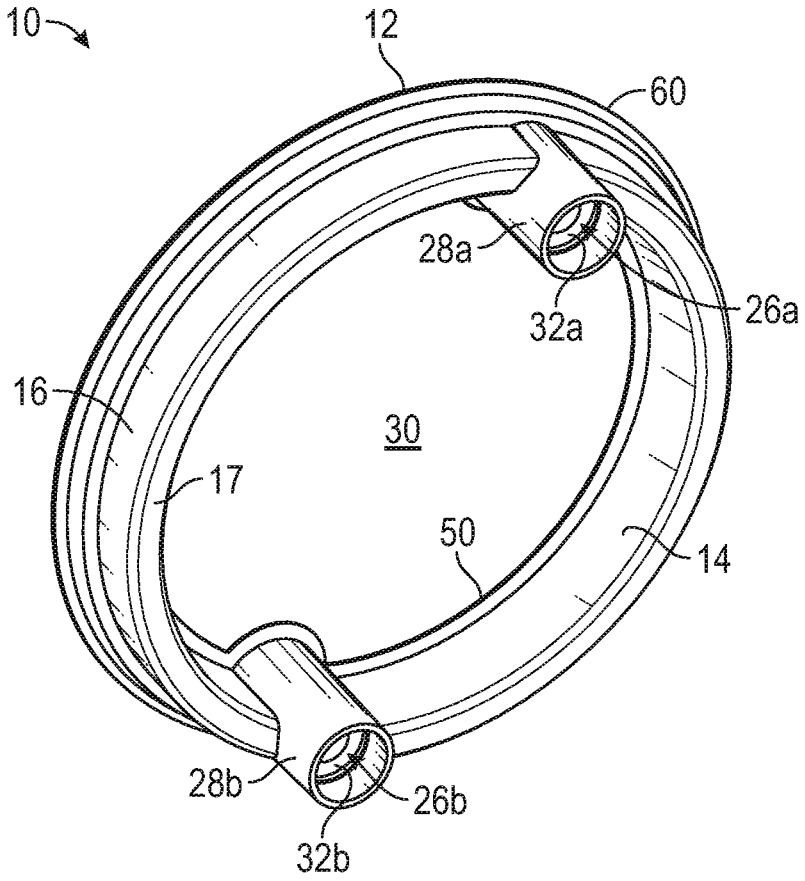
FIG. 2 is a bottom perspective view of the pool drain of FIG. 1.
Figure 3:
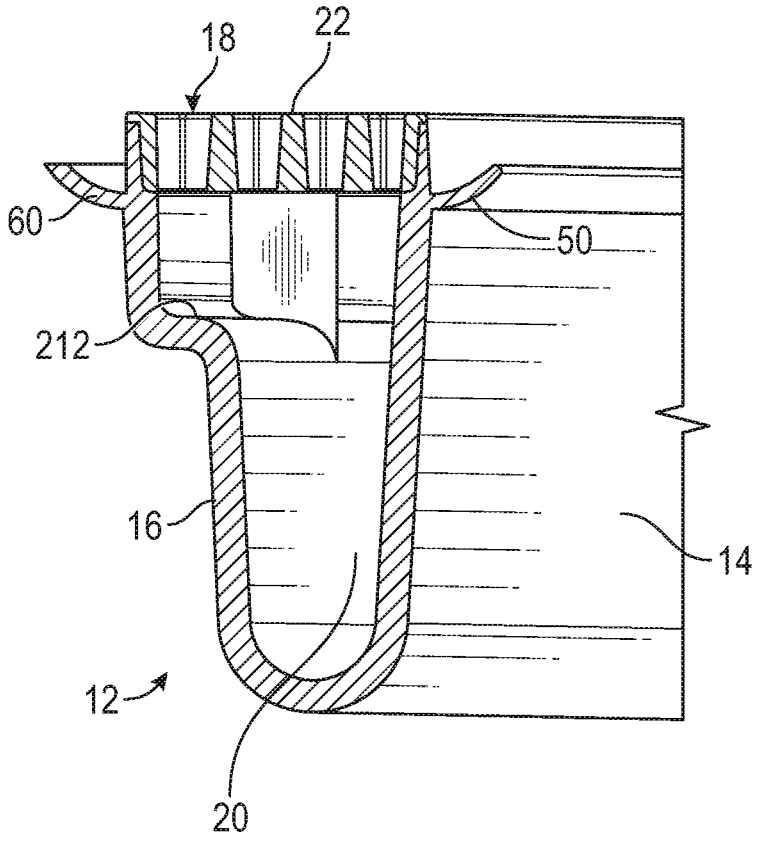
FIG. 3 is sectional view of the pool drain of FIG. 1 along line 3'-3'.
Figure 4:
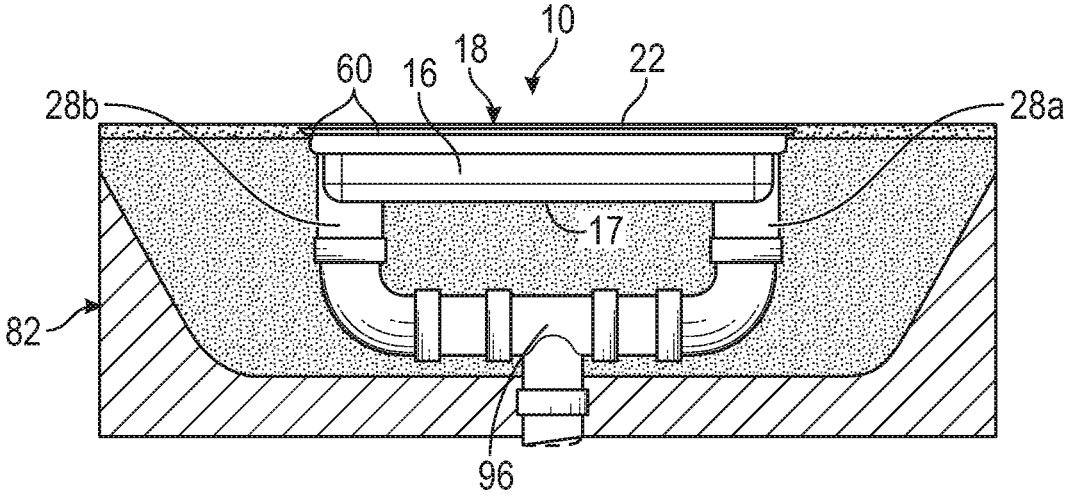
FIG. 4 is a plan view of the drain of FIG. 1 mounted in a pool floor.
Figure 5:
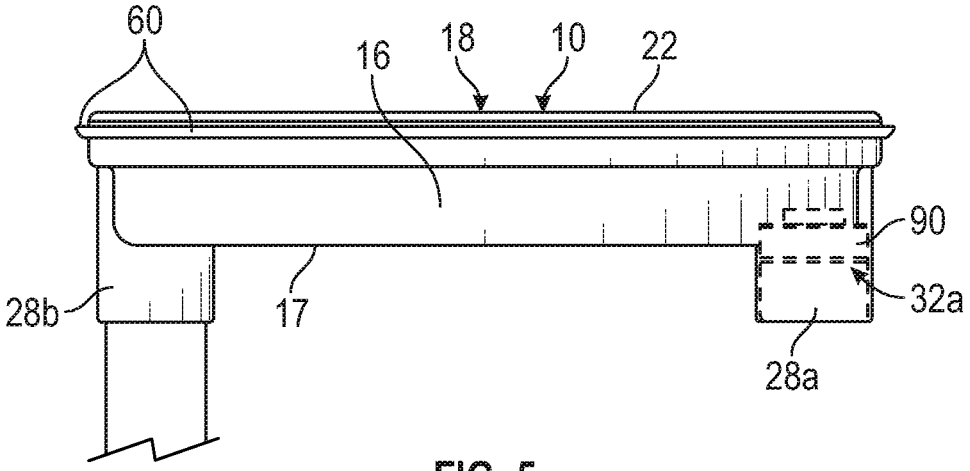
FIG. 5 is a plan view of the drain of FIG. 1 with a threaded plug installed.
Figure 6:
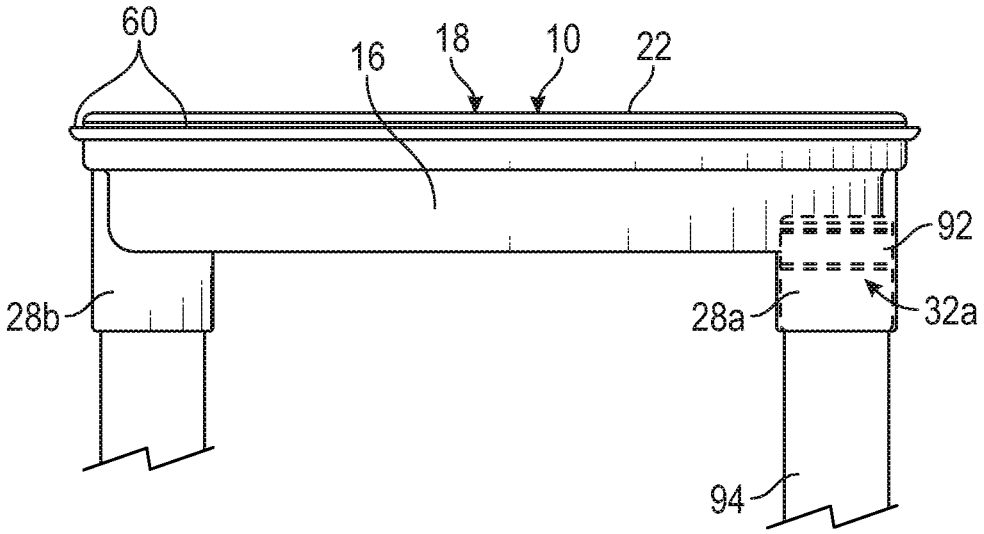
FIG. 6 is a plan view of the drain of FIG. 1 with a hydrostatic valve and optional collection tube installed.
Figure 7:
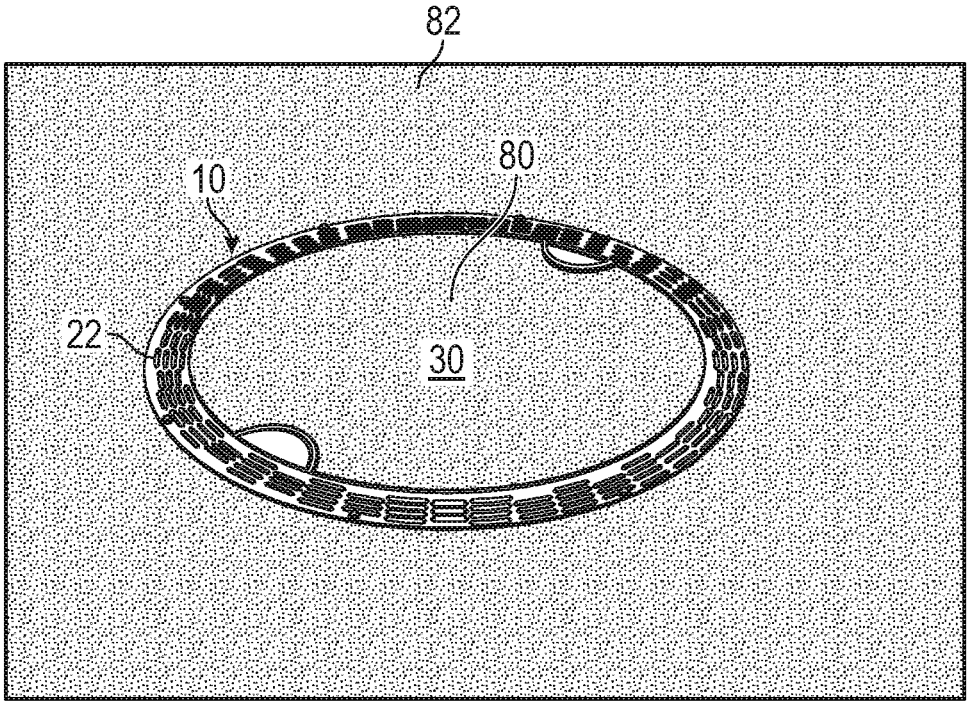
FIG. 7 is a perspective view of the pool drain of FIG. 1 mounted in the pool floor of FIG. 3.

FIG. 1 and FIG. 2 are a front perspective view and a rear perspective view, respectively, of an exemplary embodiment of a pool drain 10 of the present invention. FIG. 3 is a sectional view of the drain 10. FIG. 4 is a plan view of an exemplary embodiment of drain 10 mounted in a pool floor 82. FIG. 5 and FIG. 6 are plan views of the drain 10 with a threaded plug 90 installed or with a hydrostatic relief valve 92 and optional collection tube 94 installed, respectively. FIG. 7 is a perspective view of the pool drain 10 mounted in the pool floor 82.

The drain 10 has a ring-shaped body 12, and two outlet ports 26*a*, 26*b*, with 26*a* situated antipodal 26*b* about the ring-shaped body 12, and external peripheral flanges 50, 60 with outward flange 60 and inward flange 50 extending from the outer side wall 16 proximal to the opening 18 of the body 12. In this specific embodiment, the body 12 is injection molded hollow as a single unibody component, therefore not requiring the body 12 to be molded in separate casts and joined, which avoids manufacturing- or machining-joints, and which ultimately may create potential leak paths.

The ring-shaped body 12 has an inner sidewall 14 and an outer sidewall 16. The topside of the body 12 is generally open, while the bottom or floor 17 of the body 12 closes off the opposite side of the body 12, bridging the gap between the inner sidewall 14 and the outer sidewall 16. At the top side of the body 12, however, the inner sidewall 14 and the outer sidewall 16 are spaced apart so as to define the annular or ring-shaped opening 18, which may be sized to receive a corresponding annular or ring-shaped cover 22. The cover 22 is configured as a removable or replacement cover with openings through which water can pass from the pool into the body 12. Optionally, the cover 22 may have other types of openings 216 that allow water to pass through while stopping larger debris. The cover 22 may comprise an overhanging flange that completely covers the body 12; leaving no visible seam when installed. The body 12 and cover 22 may be made of polyvinyl chloride (PVC), acrylonitrile butadiene (ABS), or other similar materials. The cover 22 alternatively may be made of brass, stainless steel, or other similar materials as well.

In an exemplary embodiment, the body 12 is about 20 inches in outer diameter as measured to the outer sidewall 16. However, depending on the circumstances, such as pool size and type, the body 12 may range from about 8 inches to about 24 inches in outer diameter. For example, various configurations of circular drains can call for an 8-inch diameter, a 10-inch diameter, a 12-inch diameter, a 16-inch diameter, or a 24-inch diameter. Thus, the present invention is not limited to any particular size.

The two independent outlet ports 26*a*, 26*b* are situated antipodal about the ring-shaped body 12, are in fluid communication with cylindrical drainage conduits 28*a*, 28*b*, respectively, and are for draining water from the drainage channel 20 of the body 12. The drainage channel 20 is the volume within the body 12 defined by the inner sidewall 14, the outer sidewall 16, and the floor 17 of the body 12. The longitudinal axes of the drainage conduits 28*a*, 28*b* are preferably orientated perpendicular (usually vertical or substantially vertical, in practical applications on the floor 82 of a pool) to the open side of the ring-shaped body 12 (usually situated horizontal or substantially horizontal, in practical applications on the floor 82 of a pool), and are for fluidly connecting the drain 10 into the pool's pump and filter system.

Within the space circumscribed by the inner wall 14 of the ring-shaped body 12, external to the drainage channel 20, is a completely open center area 30 that is devoid of any system components or structures, and is configured to receive a filler material 80 to attractively blend the drain system with the pool wall(s) or floor 82. The open center area 30 may be filled with plaster, aggregate, epoxy, tile, plastic, fiberglass, vinyl, acrylic, etc. An embodiment is envisioned that includes additional screws, mounting ring, gasket, etc. to mount in a vinyl liner pool. The drainage conduits 28*a*, 28*b*, in their perpendicular orientation relative to the ring-shaped body 12, have a portion of their circular cross section protruding from the ring-shaped body 12 into the center area 30. This keeps the visible drain profile narrow while allowing larger plumbing conduits and pipes to be attached for increased flow through the drain 10.

In an exemplary embodiment, the drainage conduits 28*a*, 28*b* preferably are cylindrical in structure, sized on the inside to accept standard Schedule 40 pipe used in many pool installations, and sized on the outside to accept a Schedule 40 coupling one size larger (by 0.5 inches, for example) than the inside (e.g., a Socket×Spigot connection). The drainage conduits 28*a*, 28*b* may be configured as a 2 inch socket×2.5 inch spigot, a 1.5 inch socket×2 inch spigot, or a 2.5 inch socket×3.0 inch spigot. However, again depending on the circumstances, such as pool size and type, the drainage conduits 28*a*, 28*b* may be of a different Schedule size, such as thicker-walled Schedule 80 pipes. Thus, the present invention is not limited to any particular size.

The drainage conduits 28*a*, 28*b* are threaded 32*a*, 32*b*, respectively, along their inside socket connection region, at the top of the cylindrical conduit, where the inside conduit wall meets the ring-shaped drainage channel 20. The threading 32*a*, 32*b* facilitates secure socket-type connections with the drainage conduit 28*a*, 28*b*, respectively, as well as facilitates installation of maintenance or analysis equipment (a hydrostatic relief valve, for example). The threading 32*a*, 32*b* also facilitates plugging of the ports 26*a*, 26*b*, respectively.

Generally, both ports 26*a*, 26*b* operate to drain water; however, at lower flow rates through the drainage channel 20 and out through the ports 26*a*, 26*b* and into the drainage conduits 28*a*, 28*b*, one port 26*a*, 26*b* may be used for flow to the pump and one port 26*a*, 26*b* may be used to install the hydrostatic relief valve 92 or other equipment like the optional collection tube 94. In this embodiment, there is no need for the complication of having a separately dedicated access port(s) that certain prior art devices include or require. Ports 26*a*, 26*b* also allow for more flow than a single port, and two or more ports means that if one port gets blocked, water can still flow through the other ports to avoid starving the pump. In certain embodiments, flow amongst the various ports may be balanced by plumbing to a tee 96 going into a main plumbing line, for example, to the pump (the main plumbing line may be of a larger size diameter than the ports 26*a*, 26*b* off of the drainage channel 20). Both ports 26*a*, 26*b*, may be plugged with a threaded plug 90, which is complementary of the threading 26*a*, 26*b* of the drainage conduits 28*a*, 28*b*, for pressure testing, as is typically performed on every pool prior to plastering, to check for leaks in the plumbing joints.

When the pool drain system 10 is installed into the pool wall(s) or floor 82 (embedded into, or through, the main body/side wall(s) or floor 82 of a pool), the outward external flange 60 (relative to the outer wall 16 of the ring-shaped body 12) and inward external flange 50 (relative to the inner wall 14 of the ring-shaped body 12) help prevent water from passing through the boundary between the main body 12 and any surrounding material (the gunite or concrete of which the pool is constructed, for example). The outward external flange 60 and the inward external flange 50 are configured as a curved water stop extending outward and upward from the drainage channel 20 to prevent leaks and anchor the surrounding plaster, for example, against the pool drain body 12.

When the pool drain system 10 is installed into the pool wall(s) or floor 82, the opening 18 of the body 12, with or without the cover 22, preferably is substantially flush with the pool wall(s) or floor 82 when installed and embedded into the pool. Cover 20 can be flushly mounted within the body 12, or can extend upwardly into the pool volume a desired distance. In this way, the pool drain 10 is efficiently and effectively camouflaged or hidden from a user's view, or from contact with a user or pool equipment (e.g., a pool vacuum, an automatic pool cleaner). In some embodiments, the plaster, aggregate, gunite, shotcrete, etc. used to build-up the pool walls or floor 82 can flow around the body 12 and can be poured into the center opening 30.

Figure 8:
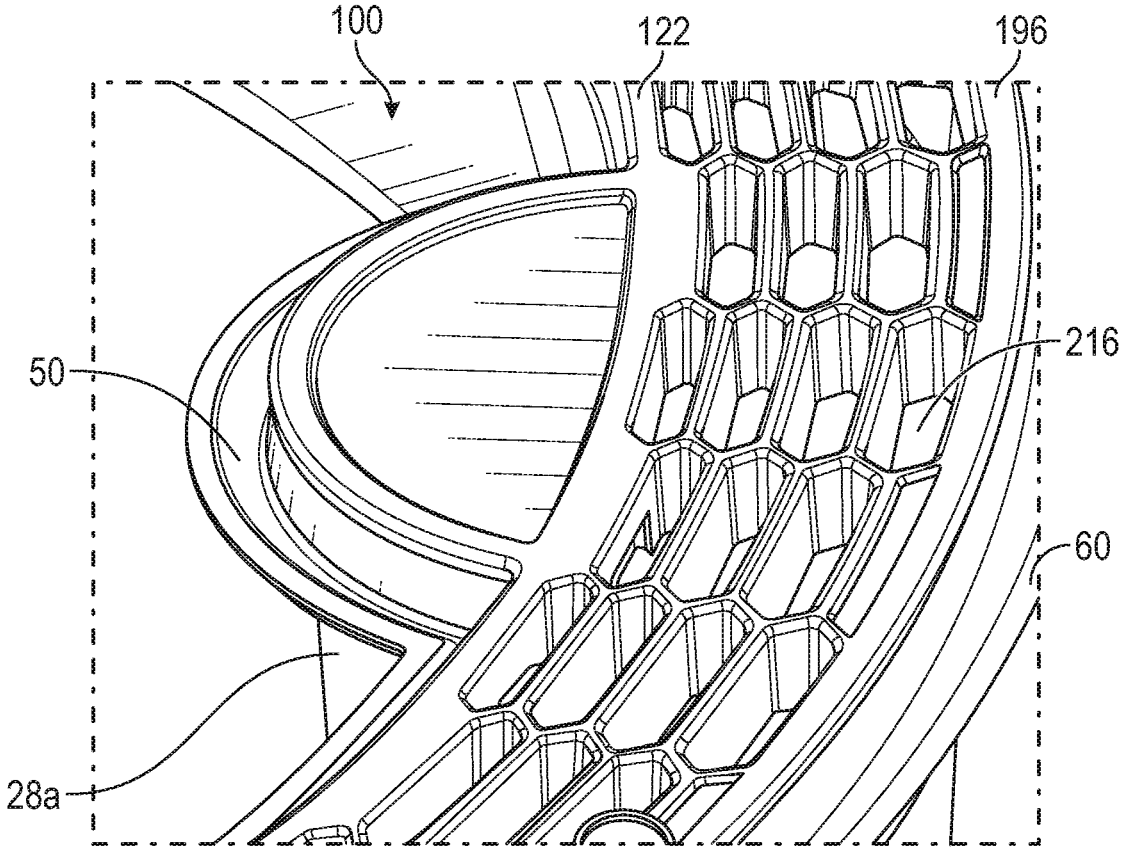
FIG. 8 is a front magnified perspective view of a second embodiment of a pool drain of the present invention.
Figure 9:
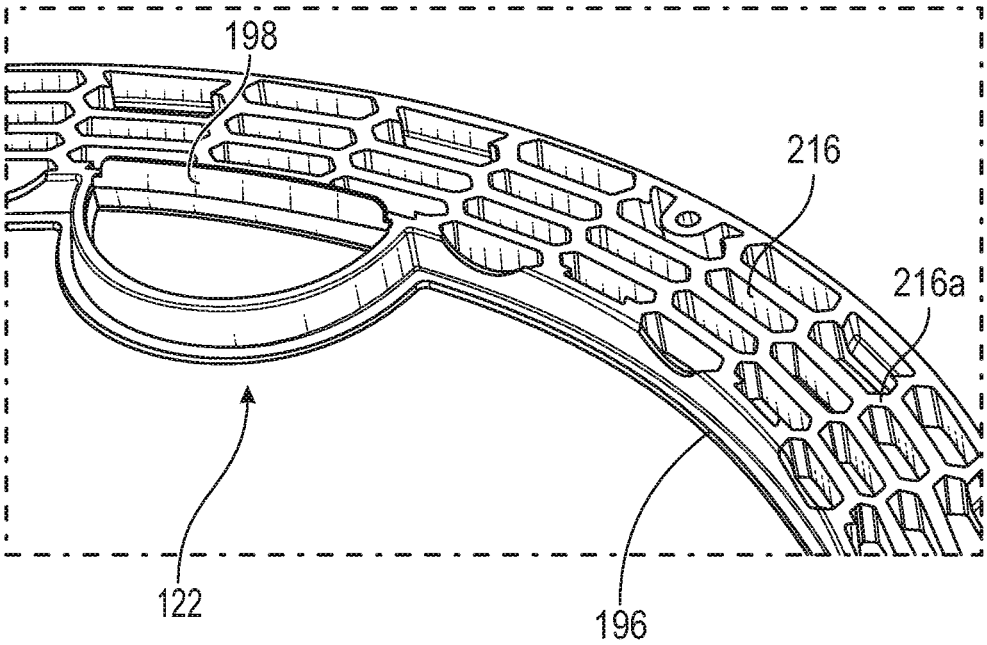
FIG. 9 is a bottom magnified perspective view of a cover of the pool drain of FIG. 8.

FIG. 8 is a top magnified perspective view of an exemplary embodiment of a pool drain 100 of the present invention. The pool drain 100 is essentially identical to the pool drain 10 of FIGS. 1-7 except for the difference described herein. FIG. 9 is a bottom magnified perspective view of a cover 122, which is one of these differences.

The drain 100, like drain 10, has a ring-shaped body 12, two drainage conduits 28*a*, 28*b*, with 28*a* situated antipodal 28*b* about the ring-shaped body 12, and an outward flange 60 and an inward flange 50. The drain 100 also has a cover 122 configured as a removable or replacement cover with openings through which water can pass from the pool into the body 12, and an overhanging flange 196 that completely covers the body 12; leaving no visible seam when installed. The cover 122 comprises a rib 198 situated at the semicircular protrusion of the ring-shaped cover 122. The rib 198 is configured to correspond to the conduit 28*a* to provide strength and/or to facilitate engagement when the cover 122 is engaged onto the ring-shaped body 12.

Figure 10:
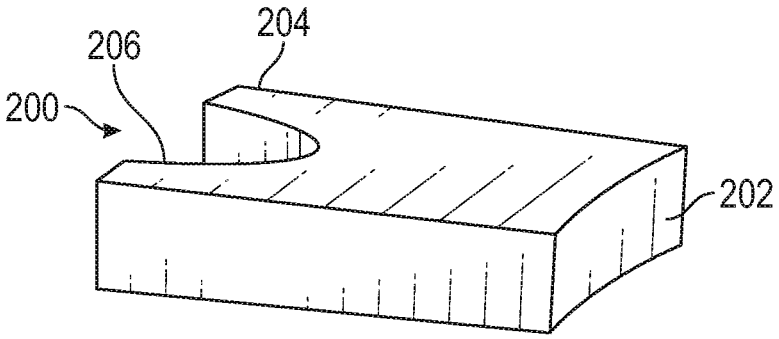
FIG. 10 is a top perspective view of an embodiment of a bridging element suitable for use in the present invention.

FIG. 10 illustrates an additional bridging element 200 feature of the invention. In another exemplary embodiment of the invention, at least one bridging element 200 is included to help prevent the opening 18 from deforming or collapsing as the plaster/concrete cures during manufacture of the pool, and/or to provide additional support for the cover 22, 122 for covering the drainage channel 20. The bridging element 200 also interrupts or substantially interrupts, depending on the size and structure of the bridging element 200, the top opening 18 of the drainage channel 20 to as to affect the flow of water into the drainage channel 20. In this embodiment, the bridging element 200 is a generally solid element having a length equal to or approximately equal to the width of the top opening 18 of the drainage channel 20, a width of preferably between about 0.5 inches to 1.5 inches (but can be any width depending on the size of the pool drain 10 and/or the support needed or desired for the cover 22, 122), and a height equal to or less than the thickness of the cover 22, 122 so that the bridging element 200 can fit within a notch 210 (see FIG. 12) in the cover 22, 122. An inner side 202 of the bridging element 200 can have a curve to it to match the curve of the inner sidewall 14 and an outer side 204 has a notch 206 in it that can fit around an attachment base 208 (see FIG. 11) for attaching the cover 22, 122 to the ring-shaped body 12.

Figure 11:
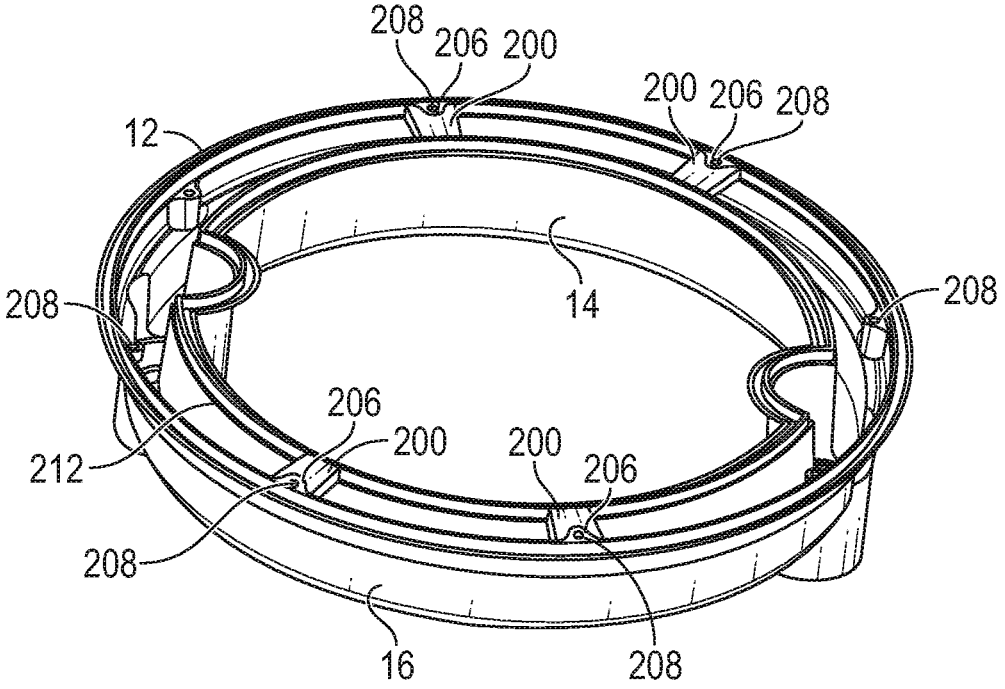
FIG. 11 is a top perspective view of a drainage channel of the pool drain of FIG. 1 showing an exemplary placement of the embodiment of the bridging element of FIG. 10.

FIG. 11 is a top perspective view of a body 12 of the pool drain 10 of FIG. 1 showing an exemplary placement of the bridging element 220. The inner sidewall 14 and the outer sidewall 16 of the body 12 have rims 212 extending inwardly for supporting the cover 22, 122, (see also FIG. 3) and the bridging element 200 makes use of the rims 212 for support. Preferably, the bridging element is placed around the attachment base 208 whereby the notch 206 cooperates with the attachment base 208 to prevent movement of the bridging element 200, that is, to hold the bridging element 200 in place. Alternatively, small bumps or features can be located on the rims 212, one on each side of the bridging element 200, to locate and hold the bridging element 200 in place. The bridging element 200 can be configured as a removable component, or can be permanently fixed in place, and at least one bridging element 200 can be used. In the embodiment shown in FIG. 11, four bridging elements 200 are used. Alternatively, the bridging elements 200 can be incorporated into and/or a part of the cover 22, 122, wherein the cover 22, 122, and the bridging elements 200 are a unitary component.

Figure 12:
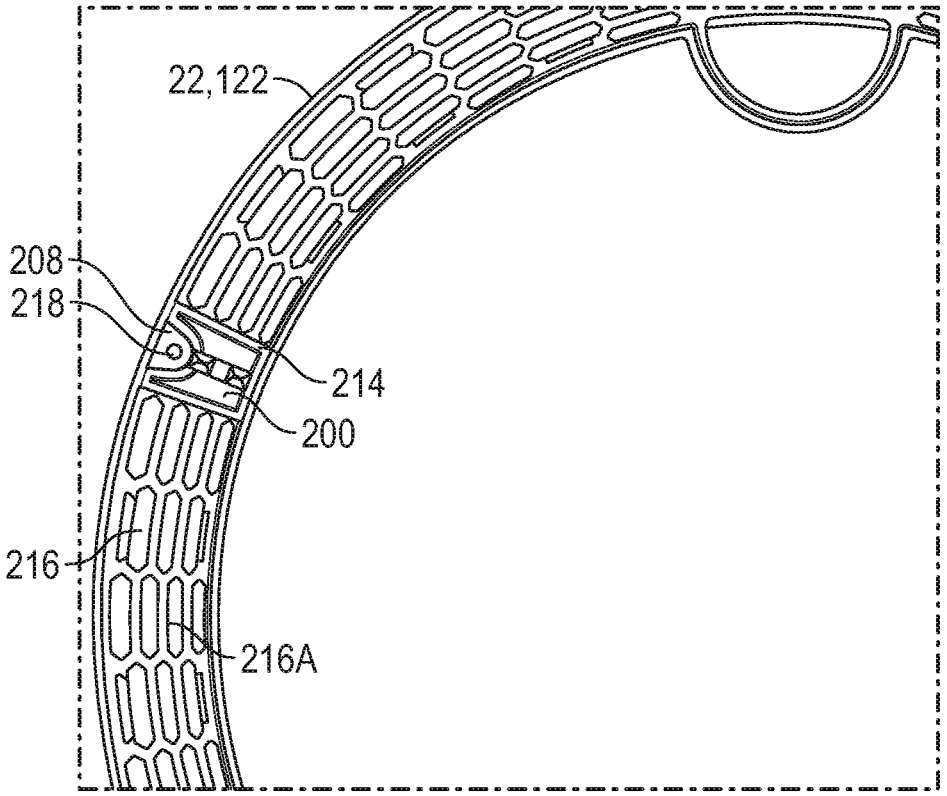
FIG. 12 is a bottom view of a grate cover showing the placement of the bridging element of FIG. 10 in recesses in the grate cover.

FIG. 12 is a bottom view of a cover 22, 122 showing the placement of the bridging element 200 in recesses 214 in the cover 22, 122. More specifically, in embodiments of the pool drain 10 that utilize a bridging element 200, the cover 22, 122 can be adapted to fit over and around the bridging element 200 when the bridging element is placed in the body 12. In comparison to the cover 122 shown in FIG. 9 where the openings 216 in the cover 122 have walls 216A the same thickness (height) as the cover 122, the cover 22, 122 for use with the bridging element 200 has recesses 214 preferably located proximal to the attachment holes 218 where the walls of the openings 216 are thinner (smaller height) thereby forming the recesses 214. Each recess 214 need only be the same size and general dimensions of, or slightly larger, the bridging element 200 so that the bridging element 200 fits with the recess 214 yet still allows the cover 22, 122, to fit and be secured properly within the top opening 18. Alternatively, the cover 22, 122 can be made as a thin piece with a consistent height (no notches) to fit above the bridging element 200 but still have a relatively low profile and remain flush with the pool wall/floor.

FIGS. 13-16 illustrate embodiments of an additional flow regulating element 220 of the invention. In another exemplary embodiment, the bridging element 200 has a flow regulating feature in the form of the flow regulating element 220 depending downward into the drainage channel 20. The flow regulating element 220 interrupts or substantially interrupts, depending on the design of the flow regulating element 220, the flow of water within the drainage channel 20. The flow interruption can reduce turbulence in the flow of water within the drainage channel 20, can help reduce the risk of entrapment, and also can trap debris that enters the drainage channel 20 through the cover 22, 122 thus preventing such debris from traveling into the water pumping system.

Figure 13:
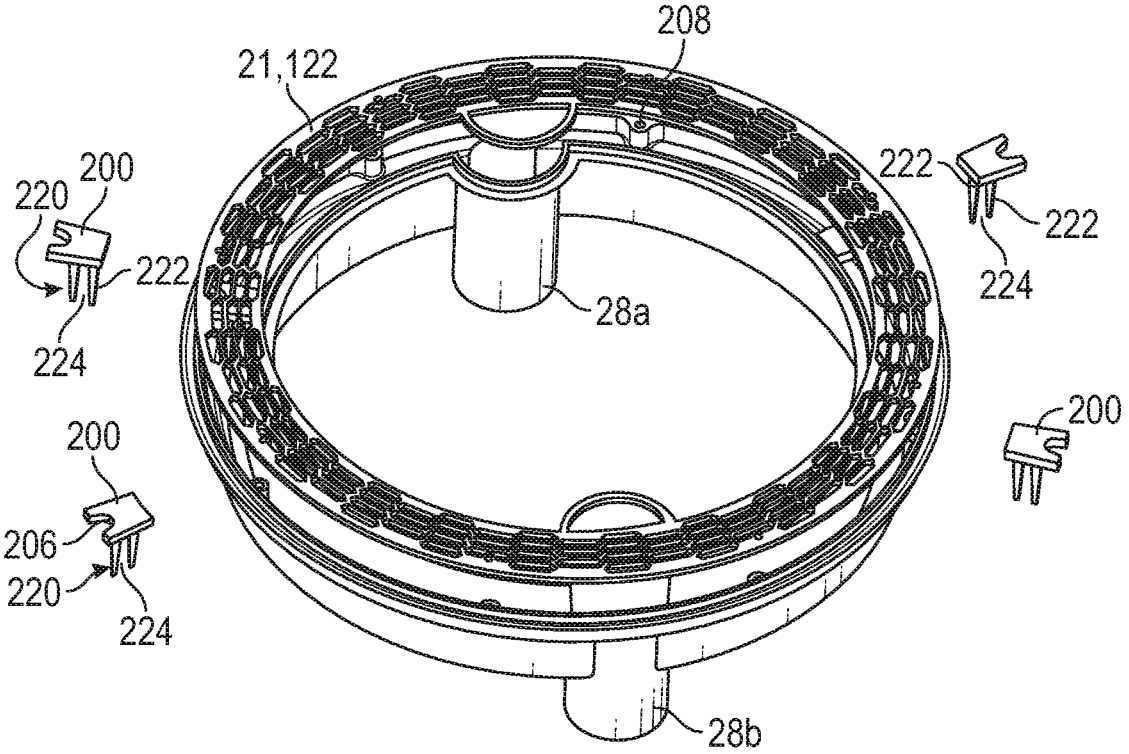
FIG. 13 is a top perspective exploded view of the pool drain of FIG. 1 showing an alternative embodiment of bridging elements having a flow regulating feature.

FIG. 13 is a top perspective exploded view of the pool drain 10 of FIG. 1 showing an alternative embodiment of bridging elements 200 having one embodiment of a flow regulating element 220. In this embodiment, the flow regulating element 220 has two projections 222 depending from the bottom side of the bridging element 220 into the drainage channel 20. The projections 222 can be any shape or size, such as the generally linear shape shown in FIGS. 13 and 14, and can have a flat, round, or other shaped horizontal cross-section. Preferably, the projections 222 are located on the bridging element 200 such that the projections are touching or proximal to the inner sidewall 14 and the outer sidewall 16 and extend the entire height, or nearly the entire height, of the drainage channel 20. These projections also can add additional support to the sidewalls 14, 16. Although two projections 222 are shown, one, three, or more projections 222 can be used. Preferably, a space 224 or opening remains between the projections 222, or between a projection and the inner sidewall 14 and/or the outer sidewall 16 opposite the projection if a single projection is used, to allow water to flow within the drainage channel 20 and past the projections 222. The projections can be sized to interrupt (50% or less interruption in this instance) or substantially interrupt (more than 50% interruption in this instance) the water flow within the drainage channel 20.

Figure 14:
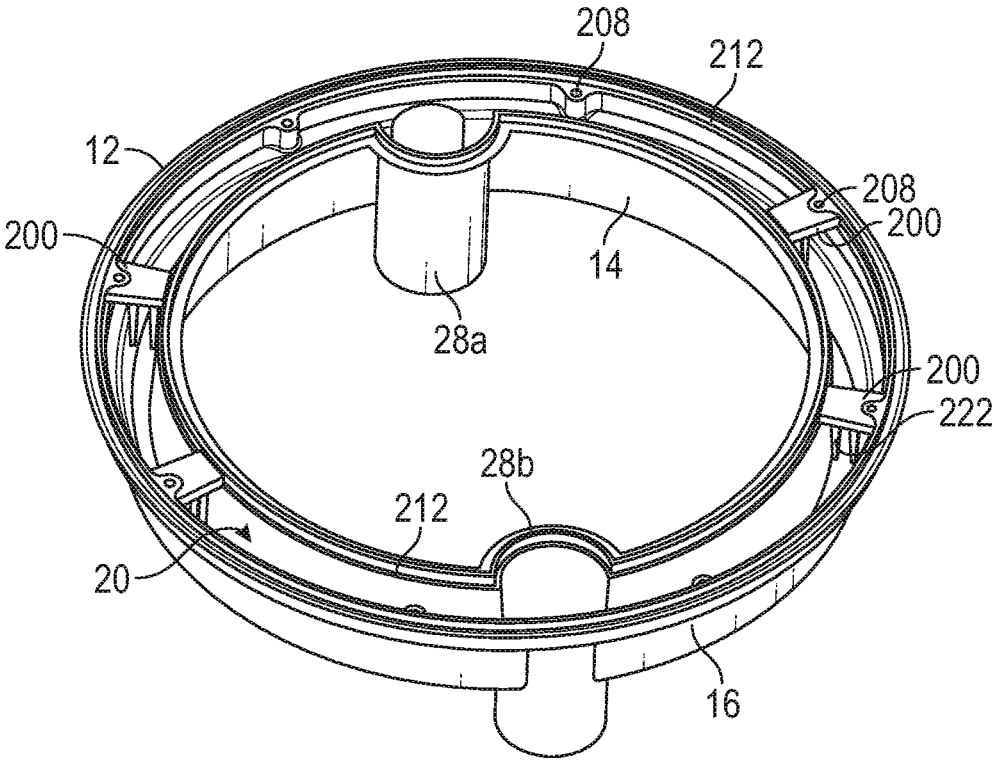
FIG. 14 is top perspective view of a drainage channel of the pool drain of FIG. 1 showing an exemplary placement of the alternative embodiment of the bridging elements of FIG. 13.

FIG. 14 is top perspective view of a drainage channel 20 of the pool drain of FIG. 1 showing an exemplary placement of the alternative embodiment of the bridging elements 200 of FIG. 13. As can be seen in FIG. 14, two projections 222 are exemplified, with the projections 222 depending downwardly from the bridging element 220 into the drainage channel 20 a distance equal to or approximately equal to the height of the drainage channel 20, and located proximal to or touching the inner sidewall 14 and the outer sidewall 16. While four bridging elements 200 are shown, fewer or more can be used, with up to eight being suitable for this embodiment of the pool drain 10 based on the number of attachment bases 208.

Figure 15:
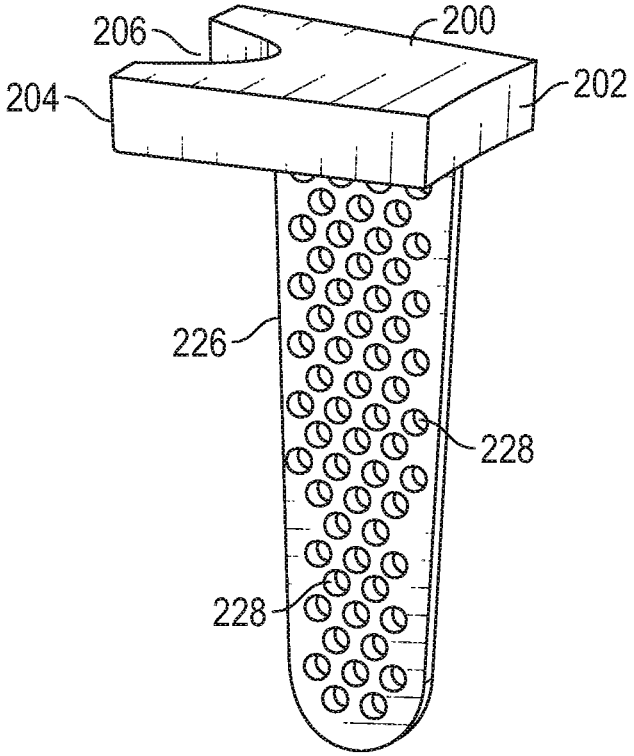
FIG. 15 is a side perspective view of an alternative embodiment of a flow regulating feature depending from a bridging element.

FIG. 15 is a side perspective view of an alternative embodiment of a flow regulating element 220 depending from a bridging element 200. The flow regulating element 220 of FIG. 15 is a baffle shaped element depending from the bottom of the bridging element 200 having a baffle portion 226 (generally equivalent to the projections 222) with holes 228 therethrough (generally equivalent to the spaces 224). The size and shape of the baffle portion 226 preferably is the same as nearly the same as the cross-section of the drainage channel 20 (for example, see FIG. 3). whereby the baffle portion 226 completely or substantially interrupts the drainage channel 20 and the holes 228 allow water to pass through the flow regulating device 220. For example, the baffle portion 226 can be any shape or size, such as the generally flat shape shown in FIG. 15, and can have a flat, oval, or other shaped horizontal cross-section. Preferably, the baffle portion 226 touches or is proximal to the inner sidewall 14, the outer sidewall 16, and the floor 17, and extend the entire height, or nearly the entire height, of the drainage channel 20. The baffle portion 226 and holes 228 can be sized to interrupt (50% or less interruption in this instance) or substantially interrupt (more than 50% interruption in this instance) the water flow within the drainage channel 20. Likewise, the baffle portions 226 can be designed with holes 228 of varying shapes and sizes to control water flow in certain areas of the pool drain 10 and lessen the likelihood of hair or body entrapment.

Figure 16:
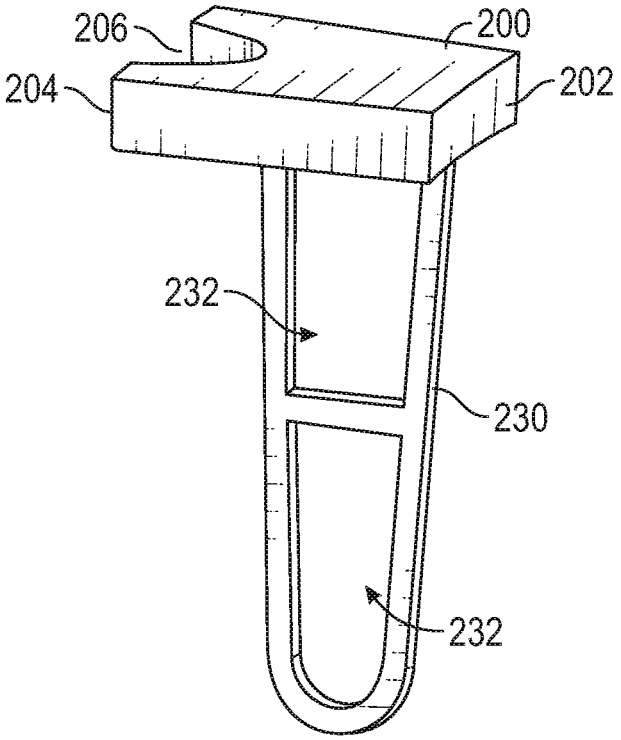
FIG. 16 is a side perspective view of another alternative embodiment of a flow regulating feature depending from a bridging element.

FIG. 16 is a side perspective view of another alternative embodiment of a flow regulating element 220 depending from a bridging element 200. The flow regulating element 220 of FIG. 16 is a frame shaped element depending from the bottom of the bridging element 200 having a frame portion 230 (generally equivalent to the projections 222) surrounding openings 232 (generally equivalent to the spaces 224). The shape of the frame portion 230 preferably is the same as or nearly the same as the U-shaped cross-section of the inner sidewall 14, outer sidewall 16, and floor 17 configuration of the drainage channel 20 (for example, see FIG. 3), with the size being sufficiently smaller so that the frame portion 230 fits within the drainage channel 20. With this configuration, the frame portion 226 interrupts or substantially interrupts the drainage channel 20 and the openings 232 allow water to pass through the flow regulating device 220. For example, the frame portion 230 can be any shape or size, such as the shape shown in FIG. 16, and can have flat, oval, or other shaped horizontal cross-sections. Preferably, the outer edges of the frame portion 230 touch or are proximal to the inner sidewall 14, the outer sidewall 16, and the floor 17 and extend the entire height, or nearly the entire height, of the drainage channel 20. The frame portion 230 and openings 232 can be sized to interrupt (50% or less interruption in this instance) or substantially interrupt (more than 50% interruption in this instance) the water flow within the drainage channel 20.

As disclosed herein, generally, both ports 26*a*, 26*b* operate to drain water; however, at lower flow rates through the drainage channel 20 and out through the ports 26*a*, 26*b* and into the drainage conduits 28*a*, 28*b*, one port 26*a*, 26*b* may be used for flow to the pump and one port 26*a*, 26*b* may be used to install the hydrostatic relief valve 92 or other equipment like the optional collection tube 94. The flow regulating devices 220 can be sized to reduce the flow within the drainage channel 20 whereby only one port 26*a* or 26*b* and one drainage conduit 28*a* or 28*b*, respectively, is necessary for draining water from the pool. To assist in accomplishing this, at least one of the flow regulating elements 220 can be a solid feature blocking or substantially blocking the drainage channel 20 and thus directing water to the port 26*a*, 26*b* and drainage conduit 28*a*, 28*b* being used to conduct water to the pool pumping system.

As shown, the bridging elements 200 and flow regulating elements 220 can be a single feature or multiple features around the drainage channel 20. These features can help prevent the opening 18 from deforming or collapsing as the plaster/concrete cures. As the cover 22, 122 fits into the opening 18, it would be difficult or impossible to attach the cover 22, 122 if the opening 18 were deformed. This phenomenon is seen in channel drains. The bridging element 200 and flow regulating element 220 features can be molded into the pool drain 10 or they can be made as a separate piece and glued, snapped, heat welded, ultrasonic welded, attached with screws, etc., in place. If a large bridging element 200 and/or flow regulating element 200 is molded in, the outside of the pool drain 10 can be contoured, notched, or cored out to maintain an even wall thickness (inner sidewall 14, outer sidewall 16, floor 17) throughout the pool drain 10.

Figure 17:
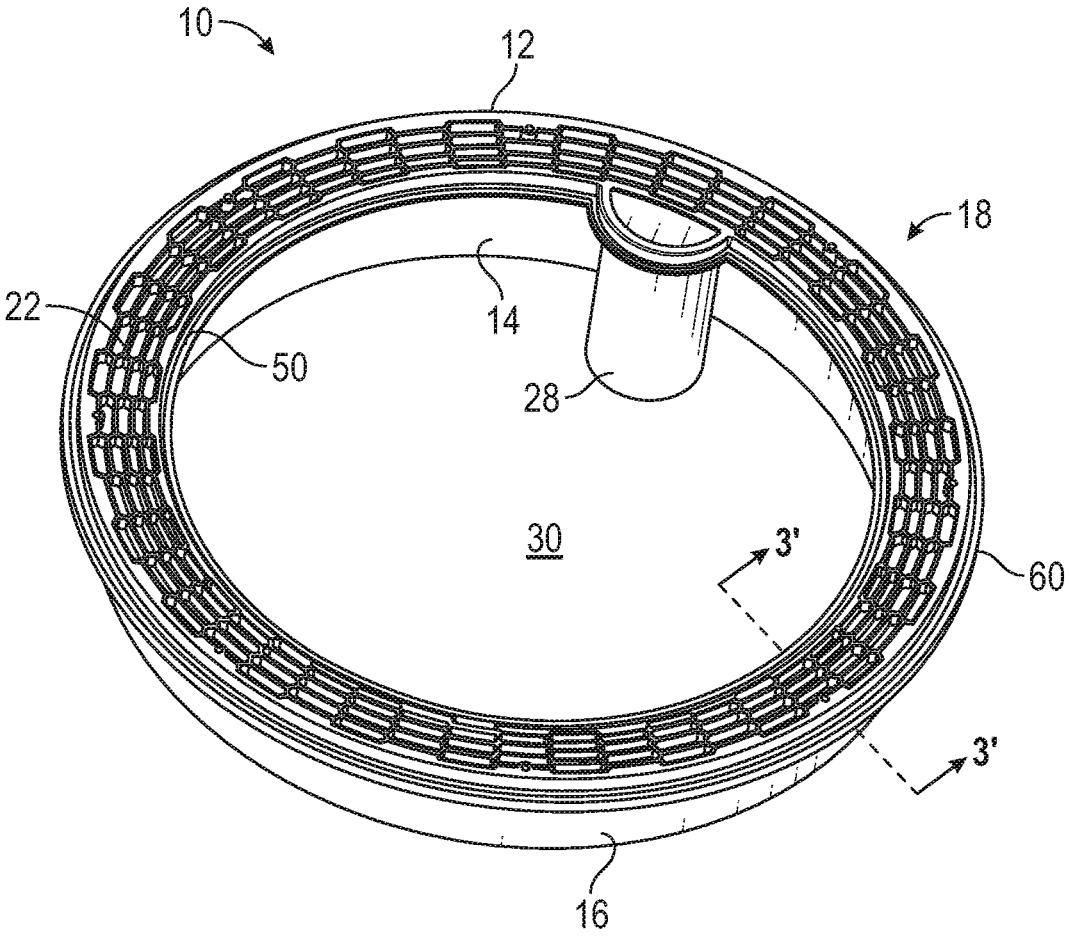
FIG. 17 is a front perspective view of an exemplary embodiment of a pool drain of the present invention similar to that shown in FIG. 1, but with one outlet port and one drainage conduit.

FIG. 17 is a front perspective view of an exemplary embodiment of a pool drain of the present invention similar to that shown in FIG. 1, but with one outlet port 26 and one drainage conduit 28. The drain 10 also has a ring-shaped body 12, and external peripheral flanges 50, 60 with outward flange 60 and inward flange 50 extending from the outer side wall 16 proximal to the opening 18 of the body 12. The remainder of the features of the pool drain 10 of FIG. 17 are identical or at least similar to the features of the pool drain disclosed in connection with FIG. 1. Bridging elements 200 and flow regulating elements 220 also can be used in this embodiment. However, as disclosed herein, multi-port 26*a*, 26*b* and multi-conduit 28*a*, 28*b* configurations of the invention can allow for a lower chance of the entire pool drain 10 being clogged, thus preventing water from reaching the pool recirculating system, and for attaching separate features to the second port 26*a* or 26*b* and conduit 28*a* or 28*b* rather than using the second port 26*a* or 26*b* and conduit 28*a* or 28*b* as a second water entry point to the pool recirculating system.

The various components of the invention can be manufactured from relatively inexpensive materials. Preferably, the components are molded or formed from a material that will not corrode or be adversely affected from the exposure to water, particularly chlorinated water, and other chemicals present in a pool setting. Such materials are known in the art The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A drain fitting comprising:

a ring-shaped body having a drainage channel, the drainage channel being defined by an inner sidewall, an outer sidewall, a floor connecting the inner sidewall and the outer sidewall and forming a bottom to the drainage channel, and an open top;

at least one drainage conduit for draining the drainage channel; and a removable ring-shaped cover with openings through which water can pass from the pool into the ring-shaped body, whereby the ring-shaped cover covers the open top of the drainage channel and comprises an integral access port cover portion above each of the at least one drainage conduit, wherein the removable ring-shaped cover and the integral access port cover portion is removable as a single piece.

2. The drain fitting as claimed in claim 1, wherein the inner wall of the ring-shaped body circumscribes an area, external to the drainage channel and internal to the ring-shaped body, that is a completely open center area devoid of any system components or structures.

3. The drain fitting as claimed in claim 2, wherein the open center area is configured to receive a filler material.

4. The drain fitting as claimed in claim 2, further comprising at least one bridging element extending between the inner sidewall and the outer sidewall across the top of the open top of the drainage channel.

5. The drain fitting as claimed in claim 4, wherein the inner side sidewall and/or the outer sidewall further comprises a rim for supporting the at least one bridging element.

6. The drain fitting as claimed in claim 4, wherein the at least one bridging element comprises a flow regulating element depending from a bottom side of the at least one bridging element and extending into the drainage channel.

7. The drain fitting as claimed in claim 6, wherein the at least one flow regulating element has a portion for blocking or interrupting a flow of water within the drainage channel and a portion for allowing the flow of water within the drainage channel, whereby the combination of the portion for blocking the flow of water and the portion for allowing the flow of water interrupt or substantially interrupt the flow of water within the drainage channel without completely blocking the flow of water within the drainage channel.

8. The drain fitting as claimed in claim 7, wherein the flow regulating element is selected from the group consisting of projections with a space between neighboring projections, a frame with at least one opening therethrough, and a baffle with at least one hole therethrough.

9. The drain fitting as claimed in claim 2, wherein each of the inner sidewall and the outer sidewall further comprise a flange, wherein the flange on the inner sidewall extends outwardly towards the center of the ring-shaped body and the flange on the outer sidewall extends outwardly away from the center of the ring-shaped body, and wherein the flanges are configured as curved water stops extending outwardly and upwardly from the drainage channel.

10. The drain fitting as claimed in claim 9, wherein at least one of the flanges is continuous about the respective inner sidewall or the outer sidewall.

11. The drain fitting as claimed in claim 9, wherein at least one of the flanges is discontinuous about the respective inner sidewall or the outer sidewall.

12. The drain fitting as claimed in claim 1, comprising two drainage conduits located antipodal from each other about the ring-shaped body.

13. The drain fitting as claimed in claim 12, wherein at least one of the two drainage conduits is configured for attachment to a pool recirculating system.

14. The drain fitting as claimed in claim 12, wherein one of the two drainage conduits is configured for attachment to other features of a pool system.

15. The drain fitting as claimed in claim 1, wherein the cover comprises an overhanging flange for covering the top of at least one of the inner sidewall and the outer sidewall.

16. A drain fitting comprising:

a ring-shaped body having a drainage channel, the drainage channel being defined by an inner sidewall, an outer sidewall, a floor connecting the inner sidewall and the outer sidewall and forming a bottom to the drainage channel, and an open top;

at least two drainage conduits for draining the drainage channel;

an outward flange and an inward flange; and a removable ring-shaped cover with openings through which water can pass from the pool into the ring-shaped body, whereby the ring-shaped cover covers the open top of the drainage channel and comprises an integral access port cover portion above each of the at least one drainage conduit, wherein the inner sidewall of the ring-shaped body circumscribes an area, external to the drainage channel and internal to the ring-shaped body, that is a completely open center area devoid of any system components or structures, the open center area being configured to receive a filler material, wherein each of the inner sidewall and the outer sidewall further comprise a flange, wherein the flange on the inner sidewall extends outwardly towards the center of the ring-shaped body and the flange on the outer sidewall extends outwardly away from the center of the ring-shaped body, and wherein the flanges are configured as curved water stops extending outwardly and upwardly from the drainage channel, and wherein the removable ring-shaped cover and the integral access port cover portion is removable as a single piece.

17. The drain fitting as claimed in claim 16, further comprising at least one bridging element extending between the inner sidewall and the outer sidewall across the open top of the drainage channel.

18. The drain fitting as claimed in claim 17, wherein the at least one bridging element comprises a flow regulating element depending from a bottom side of the at least one bridging element and extending into the drainage channel.

19. The drain fitting as claimed in claim 18, wherein the inner sidewall and/or the outer sidewall further comprises a rim for supporting the at least one bridging element.

20. The drain fitting as claimed in claim 18, wherein the at least one flow regulating element has a portion for blocking or interrupting a flow of water within the drainage channel and a portion for allowing the flow of water within the drainage channel, whereby the combination of the portion for blocking the flow of water and the portion for allowing the flow of water interrupt or substantially interrupt the flow of water within the drainage channel without completely blocking the flow of water within the drainage channel.

21. The drain fitting as claimed in claim 16, wherein the cover comprises an overhanging flange for covering the top of at least one of the inner sidewall and the outer sidewall.

22. A drain fitting comprising:

a ring-shaped body having a drainage channel, the drainage channel being defined by an inner sidewall, an outer sidewall, a floor connecting the inner sidewall and the outer sidewall and forming a bottom to the drainage channel, and an open top;

at least one drainage conduit for draining the drainage channel; and at least one bridging element extending between the inner sidewall and the outer sidewall across the drainage channel, wherein the inner wall of the ring-shaped body circumscribes an area, external to the drainage channel and internal to the ring-shaped body, that is a completely open center area devoid of any system components or structures, the open center area being configured to receive a filler material.

23. The drain fitting as claimed in claim 22, further comprising a removable ring-shaped cover with openings through which water can pass from the pool into the ring-shaped body, whereby the ring-shaped cover covers the open top of the drainage channel.

24. The drain fitting as claimed in claim 23, wherein the cover comprises an overhanging flange for covering the top of at least one of the inner sidewall and the outer sidewall.

25. The drain fitting as claimed in claim 22, wherein each of the inner sidewall and the outer sidewall further comprise a flange, wherein the flange on the inner sidewall extends outwardly towards the center of the ring-shaped body and the flange on the outer sidewall extends outwardly away from the center of the ring-shaped body, and wherein the flanges are configured as curved water stops extending outwardly and upwardly from the drainage channel.

26. The drain fitting as claimed in claim 22, wherein the at least one bridging element extends between the inner sidewall and the outer sidewall across the top of the open top of the drainage channel.

27. The drain fitting as claimed in claim 26, wherein the bridging element is incorporated into and/or a part of the cover, wherein the cover and the bridging element is a unitary component.

28. The drain fitting as claimed in claim 26, wherein the at least one bridging element comprises a flow regulating element depending from a bottom side of the at least one bridging element and extending into the drainage channel.

29. The drain fitting as claimed in claim 28, wherein the at least one flow regulating element has a portion for blocking or interrupting a flow of water within the drainage channel and a portion for allowing the flow of water within the drainage channel, whereby the combination of the portion for blocking the flow of water and the portion for allowing the flow of water interrupt or substantially interrupt the flow of water within the drainage channel without completely blocking the flow of water within the drainage channel.

30. A drain fitting comprising:

a ring-shaped body having a drainage channel, the drainage channel being defined by an inner sidewall, an outer sidewall, a floor connecting the inner sidewall and the outer sidewall and forming a bottom to the drainage channel, and an open top;

at least one drainage conduit for draining the drainage channel;

a removable ring-shaped cover with openings through which water can pass from the pool into the ring-shaped body, whereby the ring-shaped cover covers the open top of the drainage channel;

and at least one bridging element extending between the inner sidewall and the outer sidewall across the drainage channel.

31. The drain fitting as claimed in claim 30, wherein the inner sidewall and/or the outer sidewall further comprises a rim for supporting the at least one bridging element.

32. The drain fitting as claimed in claim 30, wherein the at least one bridging element comprises a flow regulating element depending from a bottom side of the at least one bridging element and extending into the drainage channel.

33. The drain fitting as claimed in claim 32, wherein the at least one flow regulating element has a portion for blocking or interrupting a flow of water within the drainage channel and a portion for allowing the flow of water within the drainage channel, whereby the combination of the portion for blocking the flow of water and the portion for allowing the flow of water interrupt or substantially interrupt the flow of water within the drainage channel without completely blocking the flow of water within the drainage channel.

34. The drain fitting as claimed in claim 33, wherein the flow regulating element is selected from the group consisting of projections with a space between neighboring projections, a frame with at least one opening therethrough, and a baffle with at least one hole therethrough.

35. The drain fitting as claimed in claim 30, wherein the inner wall of the ring-shaped body circumscribes an area, external to the drainage channel and internal to the ring-shaped body, that is a completely open center area devoid of any system components or structures.

36. The drain fitting as claimed in claim 35, wherein the open center area is configured to receive a filler material.

37. The drain fitting as claimed in claim 35, wherein each of the inner sidewall and the outer sidewall further comprise a flange, wherein the flange on the inner sidewall extends outwardly towards the center of the ring-shaped body and the flange on the outer sidewall extends outwardly away from the center of the ring-shaped body, and wherein the flanges are configured as curved water stops extending outwardly and upwardly from the drainage channel.

38. The drain fitting as claimed in claim 37, wherein at least one of the flanges is continuous about the respective inner side wall or the outer sidewall.

39. The drain fitting as claimed in claim 37, wherein at least one of the flanges is discontinuous about the respective inner sidewall or the outer side wall.

* * * * *